United States Patent [19]

Allmark et al.

[11] 4,173,381

[45] Nov. 6, 1979

[54] ELECTRICAL CONNECTORS

[75] Inventors: Reginald H. Allmark, Cheadle; Norman Bottoms, Wilmslow, both of England

[73] Assignee: International Computers Limited, London, England

[21] Appl. No.: 877,234

[22] Filed: Feb. 13, 1978

[30] Foreign Application Priority Data

Feb. 17, 1977 [GB] United Kingdom ..... 6638/77

[51] Int. Cl.[2] ..... H01R 7/08

[52] U.S. Cl. ..... 339/17 LM; 339/176 MF; 339/61 M

[58] Field of Search ..... 339/17 LM, 17 L, 176 MF, 339/61 M, 61 R

[56] References Cited

U.S. PATENT DOCUMENTS

| | | | |
|---|---|---|---|
| 3,858,958 | 1/1975 | Davies | 339/17 LM |
| 3,924,915 | 12/1975 | Conrad | 339/17 F |
| 3,985,413 | 10/1976 | Evans | 339/17 LM |
| 4,057,311 | 11/1977 | Evans | 339/17 M |

*Primary Examiner*—Gerald A. Dost

*Attorney, Agent, or Firm*—Hane, Roberts, Spiecens & Cohen

[57] ABSTRACT

An electrical connector including a rigid core having spaced shaped grooves each mounting an elongate resilient member. A flexible strip of insulating material is wrapped around the core. A plurality of spaced apart conductive strips is provided on the strip so that the strips extend circumferentially around the core.

4 Claims, 5 Drawing Figures

ELECTRICAL CONNECTORS

INTRODUCTION

This invention relates to electrical connectors. The invention is particularly although not exclusively concerned with electrical connectors for use with printed circuit boards.

One such connector is described in U.S. Pat. No. 3,858,958 and comprises a cylindrical core of elastomeric material carrying a plurality of conductive rings, which are spaced apart along the length of the core. When the connector is sandwiched between the conductors of the printed circuit boards, electrical contact is established between the boards through the conductive rings.

Clearly, the greater the spacing between the circuit boards, the greater the diameter of the connector has to be. However, large diameter elastomeric connectors are unsatisfactory, and as a result connectors of this type are generally only used for interconnecting closely spaced circuits.

One object of the present invention is to provide an electrical connector which can be used to interconnect relatively widely spaced circuit boards.

SUMMARIES OF THE INVENTION

According to a first aspect of the present invention an electrical connector includes a core comprising at least two resilient elongate members held apart laterally by a rigid spacing member positioned between the resilient members, a strip of flexible insulating material wrapped around the core so as to cover the resilient members, and a plurality of spaced-apart conductive tracks on the outer surface of the insulating strip, the tracks extending substantially circumferentially around the core.

A second aspect of the invention provides an electrical connector including a core comprising at least two resilient elongate members maintained in spaced relationship by a rigid spacing member and flexible circuit comprising conductive tracks on one surface of a strip of flexible insulating material, the flexible circuit being wrapped around the core so as to cover the resilient elongate members such that the tracks extend substantially circumferentially around the core.

Conveniently, the tracks may be formed by selectively etching a continuous conductive coating on the strip, prior to wrapping the strip around the core.

The resilient members are conveniently substantially cylindrical in shape and are located in suitably shaped grooves in the spacing member. The resilient members may be formed of an elastomeric material, or alternatively they may consist of close-coiled helical springs.

BRIEF DESCRIPTION OF THE DRAWINGS

One connector in accordance with the invention will now be described by way of example with reference to the accompanying the drawings of which.

DESCRIPTION OF THE PREFERRED EMBODIMENTS

Figure 1:
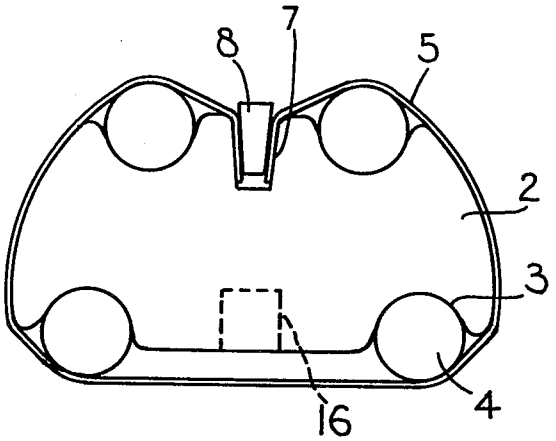

Referring to FIG. 1, the connector 1 comprises an elongate spacing member 2, approximately 1×0.5 centimeters in cross section and 5 centimetres long. The member 2 is formed from aluminium alloy by a conventional extrusion process.

The spacing member has four part-cylindrical grooves 3, two on its upper surface and two in its lower surface, these grooves running parallel to the longitudinal axis of the member. An elastomeric rod 4 (e.g. of silicone rubber) is located in each groove.

Figure 2:
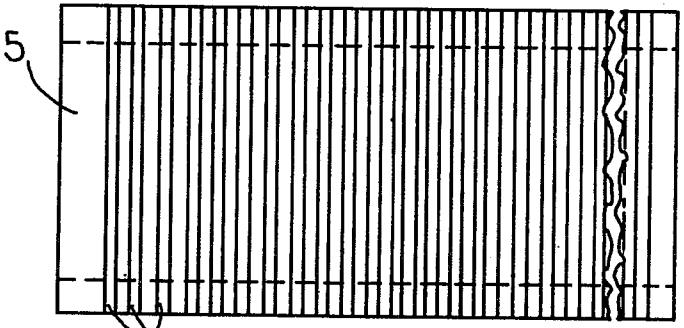
FIGS. 1 and 2 are respectively end and side elevations of the connector.

The spacing member 2 and the four rods 4 form a core around which is wrapped a thin insulating film 5 of plastics material film (e.g. melamine, polyimide). The thickness of the film can be 0.001". As shown in FIG. 2 the film carries a set of parallel conductive tracks 6 on its outer surface. These tracks are approximately 0.1 mm wide and are spaced apart by gaps of similar width. The tracks are conveniently formed by selectively etching a continuous metallic coating on the film (prior to wrapping the film around the core), using conventional photo-etching techniques. For example, the tracks can be gold plated copper tracks. In a particular embodiment the tracks were 0.003" wide and at a 0.007" pitch.

The film is held in place by inserting its ends into a groove 7 in the spacing member and then driving a wedge-shaped locking strip 8, to which adhesive has been applied, into the groove.

It should be noted that the tracks 6 stop short of the strip 8, to prevent them from being short-circuited by the strip.

Figure 3:
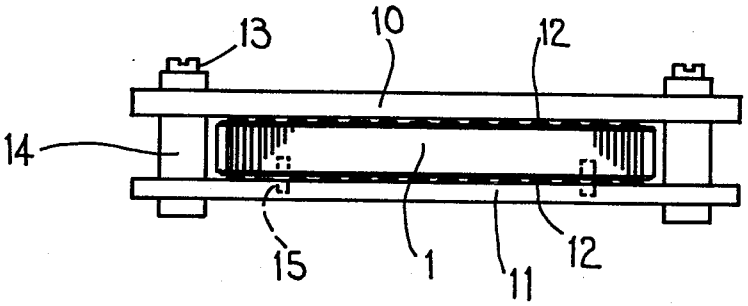
FIG. 3 is a side elevation, on a smaller scale, showing the connector being used to interconnect a pair of printed circuit boards.

FIG. 3 shows the connector 1 in position between a pair of multi-layer printed circuit boards 10 and 11. In this position, electrical contact is made between corresponding conductive areas 12 on the two boards, by way of the conductive tracks 6 on the connector. As shown in FIG. 3, the pitch of the conductive tracks 6 is substantially smaller that the spacing between the conductive areas 12, which means that the connector does not have to be accurately aligned with the circuit boards.

The circuit boards 10, 11 are secured together in an accurately spaced relationship by means of bolts 13 and spacer sleeves 14. The connector is located on one of the boards by means of a pair of dowel pins 15, which fit into holes 16 in the spacing member 2 (see FIG. 1.).

When the connector 1 is clamped between the circuit boards in this way, the four elastomeric rods 4 are compressed, and thus provide the necessary contact pressure for ensuring a good electrical contact between the tracks 6 and the conductive areas 12.

It can be seen that the connector described above allows the circuit boards 10, 11 to be spaced apart by a distance substantially greater than the diameter of the elastomeric rods, thus permitting a greater flow of cooling air over the boards.

In a modification of the arrangement described above, a direct current power supply may be carried between the boards by way of the metal spacing member 2. For this purpose, connections must be made between the member 1 and power supply terminals on the board.

Alternatively, the spacing member could be formed of a rigid but electrically insulating material.

In another modification, the elastomeric rods 4 may be replaced by a length of close coiled helical metal springs, which provide the same degree of resilience.

Figure 4:
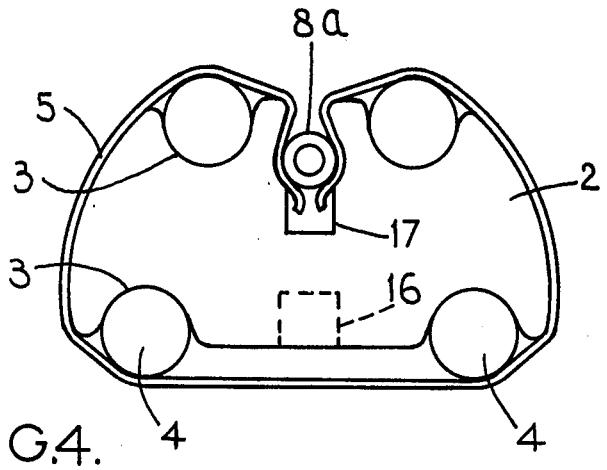
FIG. 4 is an end elevation of a modified form of the connection.
Figure 5:
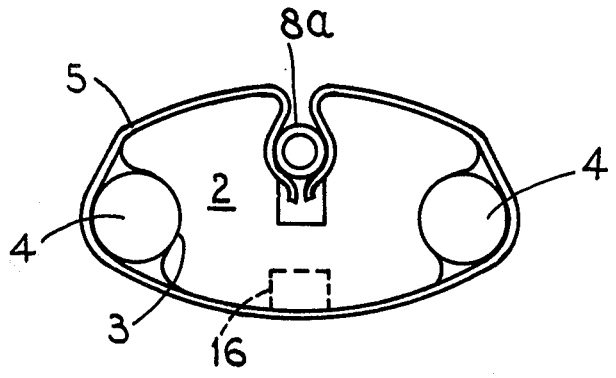
FIG. 5 is an end elevation of a second embodiment of the electrical connector.

In another modification shown in FIG. 4, the wedge-shaped locking strip is replaced by a cylindrical locking strip such as a plastic rod tube or cylinder 8A which snaps into a suitably shaped groove 17 in the member 2. The construction of FIG. 5 illustrates an embodiment in which the spacing member 2 is arranged to mount two of the elastomeric rods or close coiled springs 4. The construction is otherwise as shown in FIG. 4.

We claim:

1. An electrical connector including a core comprising at least two resilient elongate members maintained in spaced relationship by a rigid spacing member, a flexible circuit comprising conductive tracks on one surface of a strip of flexible insulating material, the flexible circuit being wrapped around the core so as to cover the resilient elongate members such that the tracks extend substantially circumferentially around the core; a channel having spaced apart walls in the rigid member for receiving the two end regions of the strip; and means separate from the resilient members for simultaneously locking the two end regions of the strip into the channel by pushing the strip end regions against the walls.

2. An electrical connector as claimed in claim 1, in that the channel is wedge shaped and the locking means is a wedge shaped locking strip.

3. An electrical connector as claimed in claim 1, in which each of the channels has a recessed part which provides a locking location zone for the locking means, which latter comprises a strip with a circular cross-section.

4. An electrical connector as claimed in claim 1, in which the channel has a region with a part circular cross-section located intermediate of the depth of the channel and the locking means to a member which is dimensioned to be a snap fit into the region.

* * * * *